United States Patent [19]

Sahara et al.

[11] Patent Number: 4,675,688

[45] Date of Patent: Jun. 23, 1987

[54] RATE SENSOR WITH COAXIALLY MOUNTED SCANNING ANTENNA

[75] Inventors: Hirokazu Sahara; Kiyoshi Nakayama, both of Tokyo, Japan

[73] Assignee: NEC Corporation, Tokyo, Japan

[21] Appl. No.: 899,744

[22] Filed: Aug. 22, 1986

Related U.S. Application Data

[63] Continuation of Ser. No. 560,002, Dec. 9, 1983.

[30] Foreign Application Priority Data

Dec. 9, 1982 [JP] Japan ..... 57-216528

[51] Int. Cl.[4] ..... H01Q 3/08; H01Q 3/00

[52] U.S. Cl. ..... 343/765; 342/359; 244/3.19; 343/781 CA

[58] Field of Search ..... 343/705, 708, 765, 766, 343/781 CA; 342/359; 244/3.19

[56] References Cited

U.S. PATENT DOCUMENTS 4,020,491 4/1977 Bieser et al. ..... 343/765
4,181,283 1/1980 Rizzo ..... 343/765
4,450,451 5/1984 La Torre et al. ..... 343/765
4,490,724 12/1984 Bickman ..... 343/765

*Primary Examiner*—Eli Lieberman
*Attorney, Agent, or Firm*—Sughrue, Mion, Zinn, Macpeak, and Seas

[57] ABSTRACT

A rate sensor, preferably comprised of a tuned gyro, has a generally cylindrical outer housing and an inner, large diameter rotary cylindrical support defining the gyro's rotary axis. The rate sensing apparatus is mounted in the volume between the outer housing and the rotary cylindrical support whereby the interior of the rotary cylindrical support defines a large diameter hollow for receiving and supporting apparatus, other than rate sensing components of the rate sensor. The rate sensor may be advantageously used with a homing device, the seeker apparatus of the device being mounted in said hollow. This produces a homing device with a high packing density and, as the rotary axis of the gyro gimbals and that of the seeker coincide, detrimental unbalance and unwanted increase in inertial movement is eliminated.

3 Claims, 4 Drawing Figures

RATE SENSOR WITH COAXIALLY MOUNTED SCANNING ANTENNA

This is a continuation of application Ser. No. 560,002 filed 12/09/83, now abandoned.

BACKGROUND OF THE INVENTION

This invention relates to a rate sensor essential to space stabilization of the tracking assembly in a homing system.

Heretofore, various kinds of rate sensors have been developed for use in navigation systems and highly accurate guidance systems. Examples of such rate sensors include fiber optic gyros, laser ring gyros, and gyroscopes equipped with a gimbal mechanism. The rate integration gyros and dynamically tuned gyros (also known as "tuned dry gyros") are known types of gambal equipped gyroscopes. When such a rate sensor is applied to a navigation or highly accurate guidance system, it is required to stabilize the gimbals on which a housing antenna or optical system is mounted. The construction of the conventional guidance system is described in, for instance, "International Offense Review", p 118, published by the Interavia S.A. in 1976. This guidance system design is such that it is equipped with an IR homing head using a cassegrain system, a reticle and an infrared (IR) detector. The homing optical system (seeker) and a gyro are mounted on gimbals and the rotational directions of the rotary axis of the gimbals are controlled by feeding back the output of the rate sensor to a torquer to make the optical system follow the target position.

As shown in the above example, the centers of the seeker axis and the rotary axis of the gimbals are perpendicular to each other to easily drive the seeker. Accordingly, the rate sensor is mounted separate from the center of the rotary axis of the gimbals. This arrangement creates certain problems which include the requirement for a large space for equipment on the gimbals, the generation of mass unbalance around the rotary axis of the gimbals, the addition of a counterbalance weight required to compensate for the mass unbalance and an increase in inertial moment around the rotary axis caused thereby.

SUMMARY OF THE INVENTION

An object of the present invention is to provide a rate sensor capable of a high packing density when other functional assemblies are simultaneously employed.

Another object of the present invention is to provide a rate sensor capable of removing mass unbalance around the rotary axis of the gimbals, and decreasing the inertial moment around the rotary axis.

Still another object of the present invention is to provide a homing apparatus equipped with the rate sensor having the above described features.

According to the present invention, it is possible to obtain a rate sensor cylindrical in shape with a hollow, wherein means for accomplishing the rate sensing function is provided in the portion other than the hollow. When a tuned gyro is employed as a rate sensor, a high packing density is made possible by providing other functioning apparatus in the large diameter hollow formed in the rotary axis. The centers of the rotary axis of the gimbals and that of a seeker are allowed to coincide with each other. Therefore, when the present invention is applied to a homing device, unbalance and an increase in inertial moment can be eliminated.

Other objects and features of the present invention will be made clear from the following description which makes reference to the drawings.

DETAILED DESCRIPTION OF THE PREFERRED EMBODIMENTS

The principal feature of the rate sensor according to the present invention is that it is cylindrical in shape with a hollow and contains the means for rate sensing in a portion of the rate sensor other than the hollow. Accordingly, the seeker of a homing antenna or optical system can be contained in the hollow of the rate sensor, which is mounted on the rotary axis of the gimbals, so that the gimbals can be readily space-stabilized by feeding back the output of the rate sensor to the gimbal drivers. If the seeker is concentrically installed in the hollow of the rate sensor, it will be possible to avoid an increase in the number of components, unbalance and inertial moment.

Description is now made of a preferred embodiment of the invention using a tuned dry gyro. The tuned dry gyro, as is well known, utilizes the angular momentum of the rotary body and is a displaced gyro having two input axes. The construction and analysis of the characteristics thereof have been described in detail in the paper "Precision Products SMART INERTIAL MEASUREMENT UNITS AND THE COMPENSATION OF DYNAMICALLY TUNED GYROSCOPES FOR STRAPDOWN INERTIAL SYSTEMS" given by C. S. Edwards MSc, BSc and R. J. Charplin C Eng, MIERE in the 31st Symposium of the AGARD Guidance and Control Panel held in October, 1980.

Figure 1:
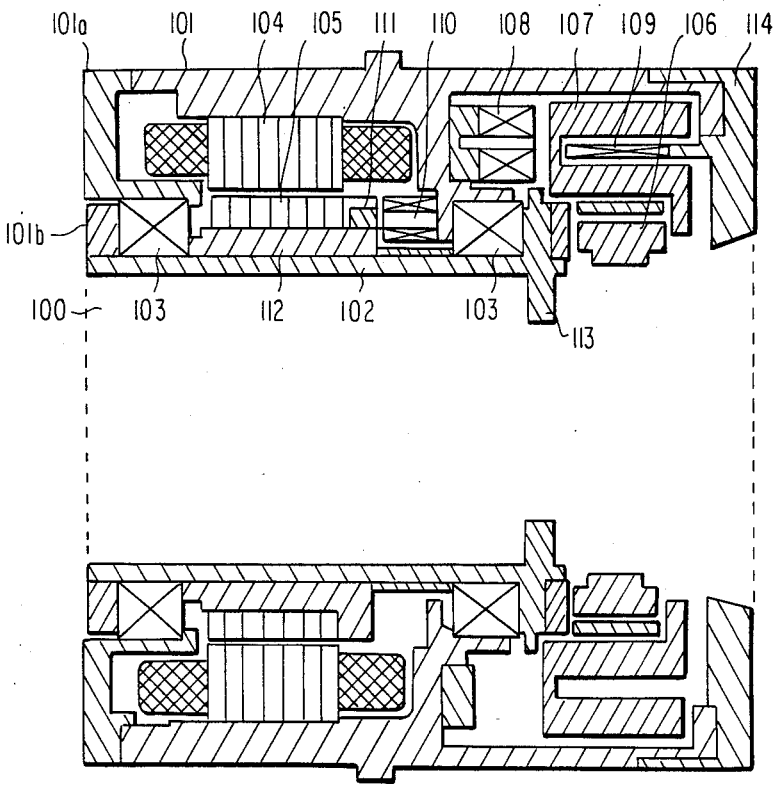
FIG. 1 is a cross-sectional view illustrating an arrangement of the exemplary embodiment of the present invention in the form of a tuned gyro.
Figure 2:
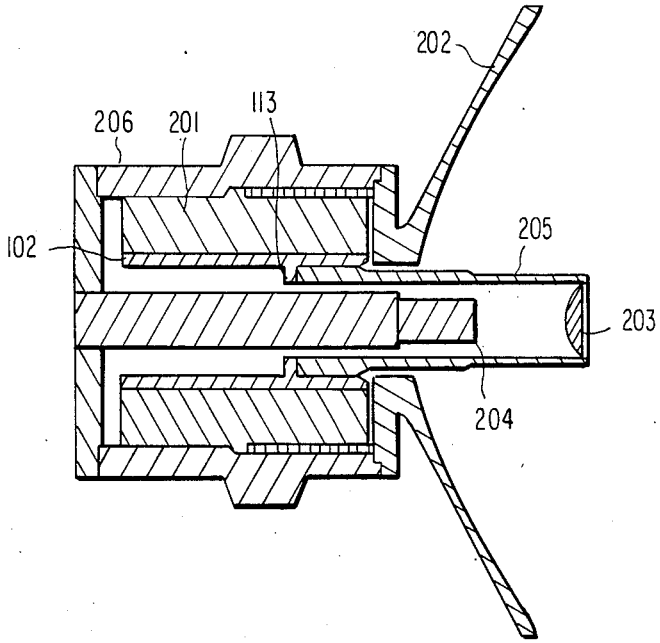
FIG. 2 is a simplified cross-sectional view illustrating a rate sensor containing a seeker of an antenna system for target tracking as an example of the effective utilization of the hollow.
Figure 3:
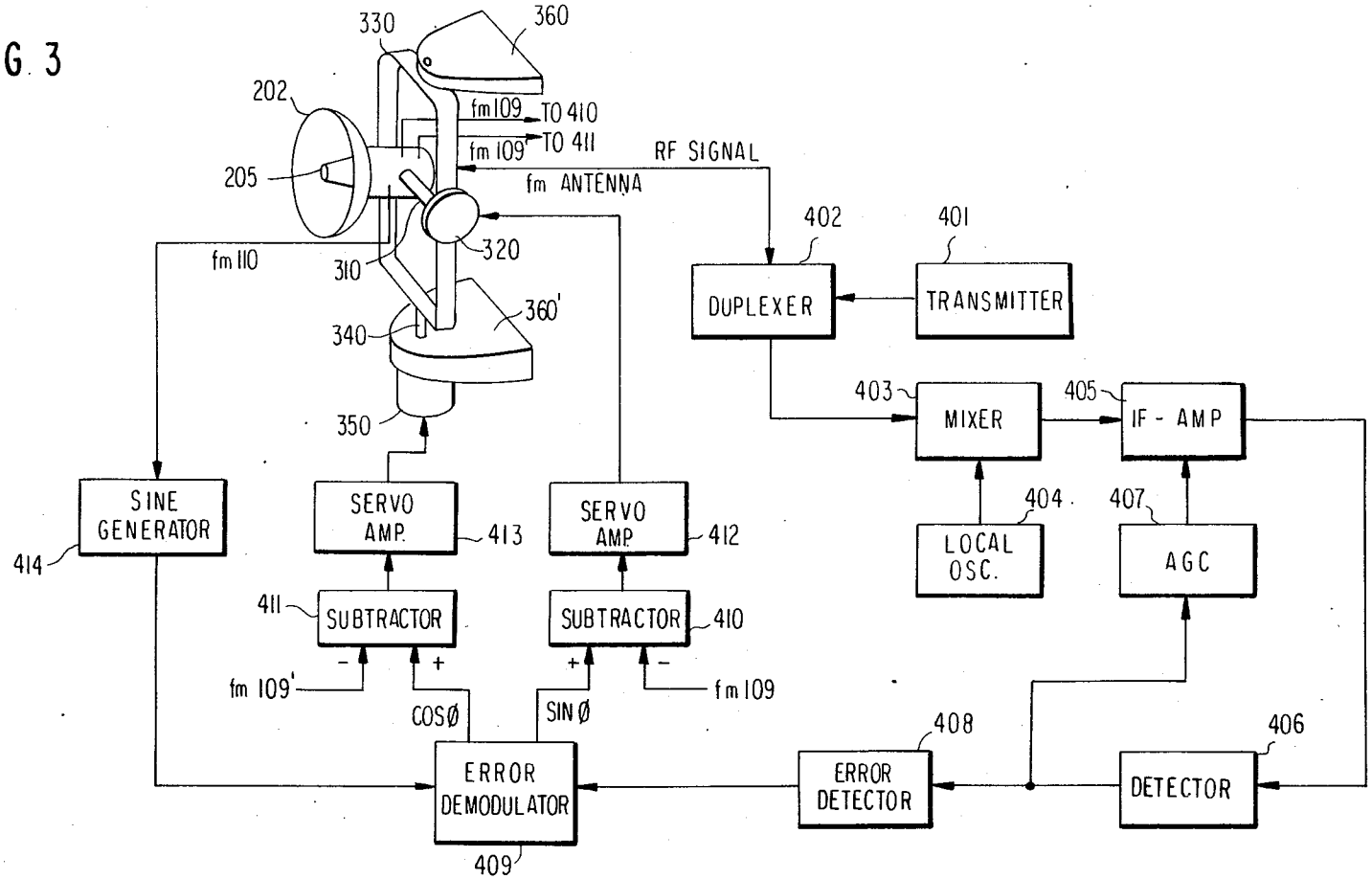
FIG. 3 is a block diagram illustrating the arrangement of a target homing device using the seeker shown in FIG. 2.

FIG. 1 shows a cross-sectional view of the tuned dry gyro (TDG) in accordance with the present invention. Although its basic construction is similar to the conventional TDG, the difference is that a rotary cylindrical support 102 defining the rotary axis has a relatively large diameter, and a hollow 100 concentric with the central axis thereof is formed. The rate sensor basically comprises a housing 101, the rotary support 102, gyro gimbals 106 and a gyro rotor (flywheel) 107. A motor rotor 105 composed of a magnetic substance with hysteresis characteristics is fixed to the rotary support 102 having a relatively large diameter through a fixing member 112. Moreover, a projection 113 is formed in the hollow 100 of the rotary support 102 for facilitating the coupling of other members thereto that are to be contained in the hollow. At least one magnet 111 is installed on the ring-like fixing member 112. On the other hand, a motor stator 104 having a coil for giving a rotating field to the motor rotor 105 is provided on the housing side. A coil 110 coaxial with the rotary cylindrical support 102 is provided at certain angular intervals (one place in this example) and spaced a certain distance from the magnet 111. The coil 110 generates electromotive voltage whenever the magnet 111 passes thereby. As is well known, the gyro gimbals 106 are coupled to the rotary support 102 through a first gimbal axis (not shown) extending in the diametrical direction and is free against the plane perpendicular to this axis. Moreover, the gyro rotor 107 is coupled to the gimbals 106 through a second gimbal axis (not shown) extending in the diametrical direction and is free against the plane perpendicular to the gyro gimbals 106. A pickup coil 108 installed in the housing 101 opposite to the gyro rotor 107 is used to electrically detect the change of the distance to the opposing gyro rotor 107 (or the change of the inclination of the gyro rotor 107). A signal corresponding to the displacement (or inclination) of the gyro rotor 107 thus detected is supplied to two torquer coils 109, 109' (not shown) provided in perpendicular relation therebetween so that the feedback loop is constructed to reduce the displacement to zero. A bearing 103 is put between the housing 101 and the rotary support 102. Furthermore, 101*a* and 101*b* are used to hold the components 103 through 109 in the ring-shaped housing 101. As to 101*a* and 101*b*, the former is fixed to the housing 101, whereas the latter to the rotary support 102. The member 114 is used to support the torquer 109:

In FIGS. 2 and 3, there is shown an example of the invention which effectively utilizes the hollow of the rate sensor shown in FIG. 1 as a packaging section for a tracking antenna used in a homing system. Specifically, a horn assembly 204 is contained in a housing 201 (a simplified version of the housing 101 in FIG. 1). An electromagnetic wave is transmitted from the assembly 204. A support ring 205 is fixed to the rotary support 102 of the rate sensor by means of the projection 113. The support ring 205 is constructed of a dielectric substance which will not absorb nor reflect an electromagnetic wave. A subreflector 203 with its reflection surface being deflected in the diametrical direction is installed on the inside of the front end thereof. For instance, a hemispherical surface whose sphere center is deflected from that of the axis of the rotary support 102 can be used as a subreflector. The main reflector 202 used to reflect the wave from the subreflector 203 in the axial direction (the direction of the antenna) is fixed to the housing 101. A space is provided in the boundary between the main reflector 202 and the support ring 205 to permit uninhibited rotation of the subreflector. Accordingly, radiant beams from the antenna are conically scanned because of the decentering action of the subreflector 203. In FIG. 2, numeral 206 indicates an inner gimbal housing for mounting the seeker including the rate sensor thus constructed on the gimbals and fixes the housing 101 of the rate sensor.

FIG. 3 shows an arrangement wherein the seeker shown in FIG. 2 is applied in a homing device. The arrangement is similar to the known radar homing system disclosed in "RADAR SYSTEM ANALYSIS" by David K. Barton, published by Prentice-Hall Inc. in 1964. As shown in FIG. 3, the inner gimbal housing 206 equipped with a rate sensor containing the antenna system is mounted on an inner gimbal axis 310. The inner gimbal axis 310 is fixed to an outer gimbal 330 connected to an outer gimbal axis 340. The inner gimbal axis 310 and the outer gimbal axis 340 are rotated by an inner drive motor 320 and an outer drive motor 350, respectively.

Figure 4:
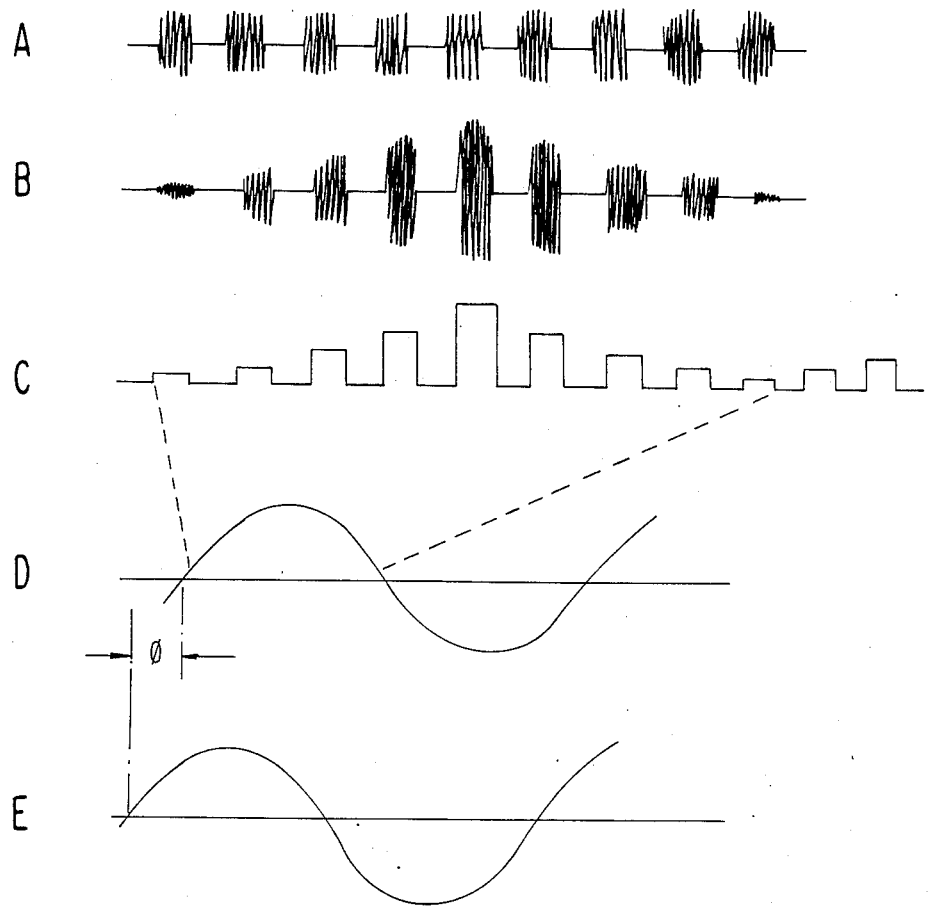
FIG. 4 shows signal waveforms for explaining the operation of the device shown in FIG. 3.

The operation in FIG. 3 will be verified by reference to the signal waveform chart in FIG. 4. The electromagnetic pulse wave A supplied to the antenna system through a transmitter 401 and a duplexer 402 is transmitted into a space through the subreflector 203 and the main reflector 202. The signal B reflected from the target is received by the antenna system and inputted to a mixer 403 through the duplexer 402. In the mixer 403, the signal from a local oscillator 404 and the received signal are mixed to generate an intermediate frequency (IF) signal. The IF signal is amplified by an intermediate frequency (IF) amplifier 405 and then subjected to envelope detection in a detection circuit 406. As a result, a pulse train signal (shown in FIG. 4C) corresponding to each of the transmitted electromagnetic pulse waves of time series can be obtained from the detection circuit 406. An AGC circuit 407 is used to control the gain of the IF amplifier 405 in such a way that the mean value of the output signal of the detection circuit 406 is made constant within the preselected period of time. As an error detection circuit 408 extracts the amplitude change in the signal pulse train, the waveform shown in FIG. 4C is subjected to envelope detection and envelope data such as illustrated in FIG. 4D, which is generally in the form of a sine wave can be obtained. By obtaining the phase difference $\phi$ between the envelope signal (wave signal of FIG. 4D) and a standard signal (sine wave signal of FIG. 4E) for rotating the subreflector 203 for conically scanning the antenna system, perpendicularly intersecting components sine $\phi$ and cos $\phi$ in the rectangular-coordinates are obtained and supplied to subtractors 410 and 411. As the standard signal for the rotation, use is made of the sine signal generated by a sine wave generator 414 synchronously with the generation of the electromotive voltage obtained in the coil 110 for detecting the rotating position of the rate sensor. The current flowing through the torquer coil 109 corresponding to each component of the two perpendicularly intersecting axes is inputted to the subtractors 410 and 411 as a rate component. The subtractors 410 and 411 are used to subtract the corresponding component signal flowing through the torquer coil from the output signal having the component of each axis of the error demodulator 409 and to supply the result to servo amplifiers 412 and 413. The outputs of the servo amplifiers 412 and 413 are supplied to the inner drive motor 320 and the outer drive motor 350 respectively to control the rotation of the inner gimbal axis 310 and the outer gimbal axis 340 rotatably installed on the foundations 360, 360', so that the antenna can be directed to the target.

As above described in this embodiment, after the error angular signals from the error demodulator 409 are amplified by the servo amplifiers 412, 413, the resulting outputs are used to drive the inner drive motor 320 and the outer drive motor 350. The rotational rate of the driving axis is obtained by the rate sensor mounted on the driving axis, whereas a feedback loop is formed to pass the output power proportional to the rate to the input side. The characteristics of the loop constitute a control system driving the gimbals with the rate (angular velocity) proportional to the output from the error demodulator.

The rate sensor thus embodied in accordance with the present invention is mounted on the gimbals together with the antenna system as shown in FIG. 2 and packaged concentrically with the antena system, so that the rotary axis of the gimbal can intersect perpendicularly to the antenna axis and the central axis of the rate sensor. Generally, it is necessary to decrease inertial moment around the rotary axis of the gimbal and mass unbalance around the gimbal axis in view of reduction in normal driving torque and stabilization against disturbance. By using the hollow formed in the rate sensor, the rate sensor can be arranged concentrically with the antenna system without changing the construction of the antenna system; consequently, it becomes possible to suppress the mass unbalance caused by an increase in an inertial moment and the transfer of the center of gravity in terms of the gimbal axis by packaging the rate sensor.

As shown in FIG. 2, the hollow in the rate sensor is provided in the rotary support 102 thereof and thus it is possible to commonly use the rotary support 102 and the driving source for rotating the subreflector for conical scanning. As a result, the rate sensor can be made further compact, with a low inertial moment, by the common use of the driving source.

As above described, according to the teachings of the present invention, the rotary support, defining the rotary axis, of the rate sensor has a hollow used to carry devices other than the rate sensor. Therefore the present invention provides the advances of minimizing the mounting space, eliminating the mass unbalance, reducing the inertial moment (the inertial moment of what is mounted on the gimbal around the gimbal axis) and decreasing its size as well as increasing the energy utilization efficiency by integrating the rotating function. It is clear that the above described effects are not limited to the tuned dry gyro described in the above described embodiments.

What is claimed is:

1. In a homing apparatus, a rate sensor comprising a tuned dry gyro having a rotary support (102) adapted to rotate with respect to a housing (101) thereof, said rotary support having a hollow extending in the direction of its rotary axis, a gyro gimbal (106) adapted to freely incline in two directions perpendicular to each other, and a gyro fly wheel (107) coupled to said gyro gimbal;

an inclination measuring means (108) for measuring the inclination of said gyro gimbal to said rotary axis;

at least one torquer coil (109) for actuating said gyro gimbal to make the inclination of said gyro gimbal in said two directions zero in response to torquer current determined in response to said inclination measuring means;

rate sensing means for determining an angular rate of said gyro gimbal on the basis of said torquer current; and radiating/receiving means for radiating radiation energy into a limited area or receiving radiation energy from a limited area, said radiating/receiving means being controlled by said angular rate;

said radiating/receiving means comprising a main focussing reflector (202) fixed to said housing (101), a dielectric support tube (205) fixed to said rotary support coaxial with said rotary axis, an off-center subreflector (203) mounted at the end of the support tube at the focus of the reflector, and a waveguide means (204) fixed to an end portion of the housing and located in said hollow for feeding or receiving energy with respect to said subreflector.

2. A rate sensor according to claim 1 wherein said rate sensing means is comprised of at least one magnet (111) installed on said rotary support and a coil (110) installed at said housing and facing said magnet.

3. A rate sensor according to claim 1, further comprising:

a detector for envelope-detecting a signal corresponding to the received radiation energy;

an error demodulator for determining the phase difference $\phi$ between said detector output and a reference signal representative of the rotary angular information of said rate sensing means and outputting a sin $\phi$ signal and a cos $\phi$ signal as respective axis components of said two perpendicular axis directions;

subtractors for outputting the difference signal between said torquer current, and said sin $\phi$ and cos $\phi$ signals of the respective corresponding axis directions; and an inner gimbal and an outer gimbal for rotating said housing in two axial directions perpendicular to each other to direct said main reflector to said limited area in response to the outputs of said subtractors.

* * * * *